US005158147A

United States Patent [19]

Pavey et al.

[11] Patent Number: 5,158,147

[45] Date of Patent: Oct. 27, 1992

[54] AUGER CUTTER HEAD

[75] Inventors: Harry W. Pavey, Zionsville; Michael T. Burton, Indianapolis, both of Ind.

[73] Assignee: Mobile Drilling Company, Inc., Indianapolis, Ind.

[21] Appl. No.: 743,101

[22] Filed: Aug. 9, 1991

[51] Int. Cl.[5] ..... E21B 10/44

[52] U.S. Cl. ..... 175/385; 175/394; 299/87

[58] Field of Search ..... 175/257, 385, 386, 394, 175/401; 299/87, 89

[56] References Cited

U.S. PATENT DOCUMENTS 3,375,890 4/1968 Petersen ..... 175/385

4,380,271 4/1983 Baker et al. ..... 175/394 X

OTHER PUBLICATIONS

Auger and Soil Sampling Tools Catalog, Mobile Drilling Co., Inc., 1990, pp. 2-1 to 2-13 and front and back covers.

Bulletin 3788-A, Supplement to Mobile Drilling Co., Inc., Catalogs 182 & 747, Effective Jan. 26, 1989, pp. 1-4.

Mills Machine Company Brochure, 1989, pp. 1-4.

*Primary Examiner*—William P. Neuder

*Attorney, Agent, or Firm*—Barnes & Thornburg

[57] ABSTRACT

An auger cutter head includes a rotatable body that is mountable on an auger and a plurality of cutting assemblies spaced about the outer wall of the rotatable body to drill a hole in the ground as the auger cutter head is rotated and advanced into the ground. Two of the cutting assemblies include outside chisel bits positioned to ream or gauge the hole as the cutter head is rotated and advanced. All of the flighting sections, bit, blocks, and blade assemblies provided in the cutting assemblies are offset in a radially inward direction relative to the two outside chisel bits to reduce the wear and tear on those components. Each of the chisel bits is oriented to rotate relative to its bit block about a predetermined axis of rotation to reduce wear caused by uneven loading on the rotatable chisel bits during drilling of the hole.

23 Claims, 3 Drawing Sheets

AUGER CUTTER HEAD

BACKGROUND AND SUMMARY OF THE INVENTION

This invention relates to drilling tools for hollow-stem augers, and particularly to an auger cutter head for drilling a hole sized to receive the hollow-stem auger therein in hard ground formations. More particularly, this invention relates to an auger cutter head having a body and plurality of chisel bits and cutter blades oriented and arranged about the circumference of the body to improve drilling performance of the cutter head and extend the useful life of the cutter head.

A hollow-stem auger is recognized in various construction, geotechnical, and environmental fields as a versatile, fast, and effective tool for simultaneously advancing and casing a drill hole in a wide variety of ground formations. Typically, a center stem of the auger is quickly removed once the desired drilling depth is achieved to allow working inside the auger using coring tools, soil sampling equipment, in-hole hammers, back rods and cables, environmental monitoring equipment, and other apparatus. The hollow-stem auger is widely used in conjunction with ground water monitoring and hazardous waste operations and other geotechnical and exploration drilling applications.

It is well known to mount a cutter head on the bottom end of a hollow-stem auger to provide means on the auger for penetrating and drilling into wet, dry, soft, hard, loose, or coarse ground formations as the hollow-stem auger is driven into the ground using a conventional drill rig. The cutter head rotates and advances with the auger as the auger is driven into the ground by the drill rig. Conventional cutter heads include chisel bits and cutter blades that cooperate to break up the ground and any foreign objects therein, thereby generating ground waste materials known as "spoils" or "cuttings." The conventional auger itself trails the cutter head and typically includes a central shaft and a series of slightly tapered concave flights. These flights are mounted on the central shaft of the auger and are designed to throw these cuttings against the central shaft so that the cuttings can be carried upwardly toward the surface by the flights as the auger and cutter head are rotated and driven further into the ground by the drill rig.

It has been observed during the development of this invention that the various components (e.g., flight sections, bit blocks, and chisel bits) included in conventional cutter heads wear out quickly as a result of repeated contact with a variety of difficult-to-cut hard objects in the ground. In many environmental applications, it is necessary to drive an auger cutter head into ground in an environmental clean-up area that contains, for example, railroad ties, cement reinforcing rods, discarded appliances, and other items that are difficult to cut using a conventional auger cutter head. In geotechnical and exploration applications, it is often necessary to drill into hard-to-drill formations, including gravels, hardpan, till, and caliche.

One problem with conventional cutter heads is that they include flighting sections and bit blocks that form the radially outermost part of the cutter head and function as the primary means for engaging the ground formation to ream or gauge the hole being drilled. These conventional flighting sections and bit blocks take a beating as a result of being banged against hard ground formations and hard objects in the ground during rotation of the advancing cutter head. These conventional cutter head components tend to wear out quickly if the cutter head is used to drill a hole in hard ground formations littered with buried hard objects or filled with difficult-to-drill formations. These conventional cutter heads have a tendency to drag or become wedged in the hole because the cutter head is not effectively reaming or gauging the hole by cutting sufficient clearance for the body of the cutter head to go further downward into the ground. Also, it has been observed that the torque and shock loading on the auger cutter head increased as the conventional cutter head struggled to penetrate and cut through hard ground formations and/or various hard objects littered through the strata in ground that had been used as a refuse dump. A new cutter head configured to reduce exposure of flighting sections, bit blocks, and other adjacent components to contact with hard objects and ground formations and enhance the means for reaming or gauging the hole being drilled would be an improvement over conventional cutter heads.

Another problem with conventional cutter heads is that they include rotatable chisel bits that wear unevenly as the chisel bits rotate about an axis of rotation in the bit blocks as they frictionally engage ground and other material during drilling of the hole. It has been observed that many conventionally mounted and oriented chisel bits tend to flatten or wear on one side because they are not rotating properly about their axis of rotation during rotation of the conventional cutter head about its own axis of rotation. A new cutter head configured to orient the chisel bits so as to produce consistent rotation of each bit during drilling of the hole would be an improvement over conventional cutter heads.

A more durable auger cutter head would better meet the demands encountered, for example, during environment clean-up drilling or geotechnical exploration drilling. An object of the present invention is to provide an improved cutter head having flighting sections, bit blocks, chisel bits, and other components that are mounted, arranged, and oriented in such a way as to enhance the drilling performance and extend the useful life of the auger cutter head.

According to the present invention, an improved cutter head is provided for use with a hollow-stem auger or the like. The cutter head rotates with the hollow-stem auger about its axis of rotation to drill into the ground and produce a hole having a cylindrical side wall of a predetermined inner diameter. The cutter head includes a cutter body having means for connecting to the hollow-stem auger to rotate and move therewith and a plurality of spaced-apart cutting assemblies mounted on the cutter body.

A first of the cutting assemblies includes a first outside chisel bit having a base and a tip, and first mounting means for mounting the base on the cutter body to position the tip at a first predetermined distance from the axis of rotation of the hollow-stem auger to provide means for gauging the predetermined inner diameter of the hole. The first outside chisel bit penetrates material in the ground to be cut and the tip generates the cylindrical side wall of the hole to be drilled in response to motion of the cutter body around and along the axis of rotation of the hollow-stem auger during drilling of the hole.

In preferred embodiments, the first mounting means includes a flighting section mounted on the cutter body and a bit block fixed to the flighting section to support the first outside chisel bit for rotation about its own axis of rotation upon frictional engagement with the ground during drilling of the hole. Advantageously, the flighting section and the bit block of this first cutting assembly (and of every other cutting assembly on the cutter head) are offset from the tip of the first outside chisel bit in a radially inward direction toward the axis of rotation of the hollow-stem auger so that none of these flighting sections and bit blocks ream or gauge the predetermined inner diameter of the hole as it is being drilled, thereby reducing wear of these parts. Instead, the improved cutter head is constructed so that only the tip of the first outside chisel bit reams or gauges the predetermined inner diameter of the hole as the tip orbits about the axis of rotation of the hollow-stem auger during drilling of the hole.

Also in preferred embodiments, a second outside chisel bit is added so that two of the chisel bits on the cutter head are positioned to ream or gauge the hole being drilled. These two outside chisel bits are spaced apart from one another to balance the cutter head and center the cutter body as it is driven downwardly further into the ground during drilling of the hole. It has been observed that many conventional cutter heads actually produce unwanted elliptically shaped drilled holes because they are unable to remain in a proper, centered position within the hole being drilled.

In addition, a third chisel bit (known as an "inside" chisel bit) is mounted and oriented to enlarge a pilot hole dug by a conventional pilot bit along the axis of rotation of the hollow-stem auger to provide a large diameter "coring hole" inside the hollow-stem auger into which various coring, sampling, and monitoring equipment can be inserted once the hole drilled by the cutter head has been completed. Further, a fourth chisel bit (known as a "center" chisel bit) is mounted and oriented to penetrate and fracture material in the ground between the inside and the two outside chisel bits.

Preferably, each of the four chisel bits in the illustrated embodiment is mounted and oriented to align its axis of rotation at a predetermined compound angle relative to the axis of rotation of the cutter body (which is coextensive with the axis of rotation of the hollow-stem auger). These compound angles have been preselected to maximize consistent rotation of each chisel bit about its own axis of rotation upon frictional engagement with the ground during drilling of the hole. Advantageously, such rotation distributes the load on the shoulder of each chisel bit and promotes more even wear on the rotatable chisel bits to enhance drilling performance and extend the useful life of the chisel bits.

A cutter head in accordance with the present invention is configured to cut harder formations at increased penetration rates over a longer useful life. Thus, such improved cutter head of the present invention is designed to reduce drilling costs and improve drilling performance.

It is contemplated that a cutter head in accordance with the present invention can be produced to include, for example, three chisel bits. When drilling smaller diameter holes, it is convenient to provide a cutter head including only an outside chisel bit, an inside chisel bit, and a center chisel bit. Depending upon the application, it is within the scope of the present invention to use an outside chisel bit on a cutter head in combination with one or more other chisel bits.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
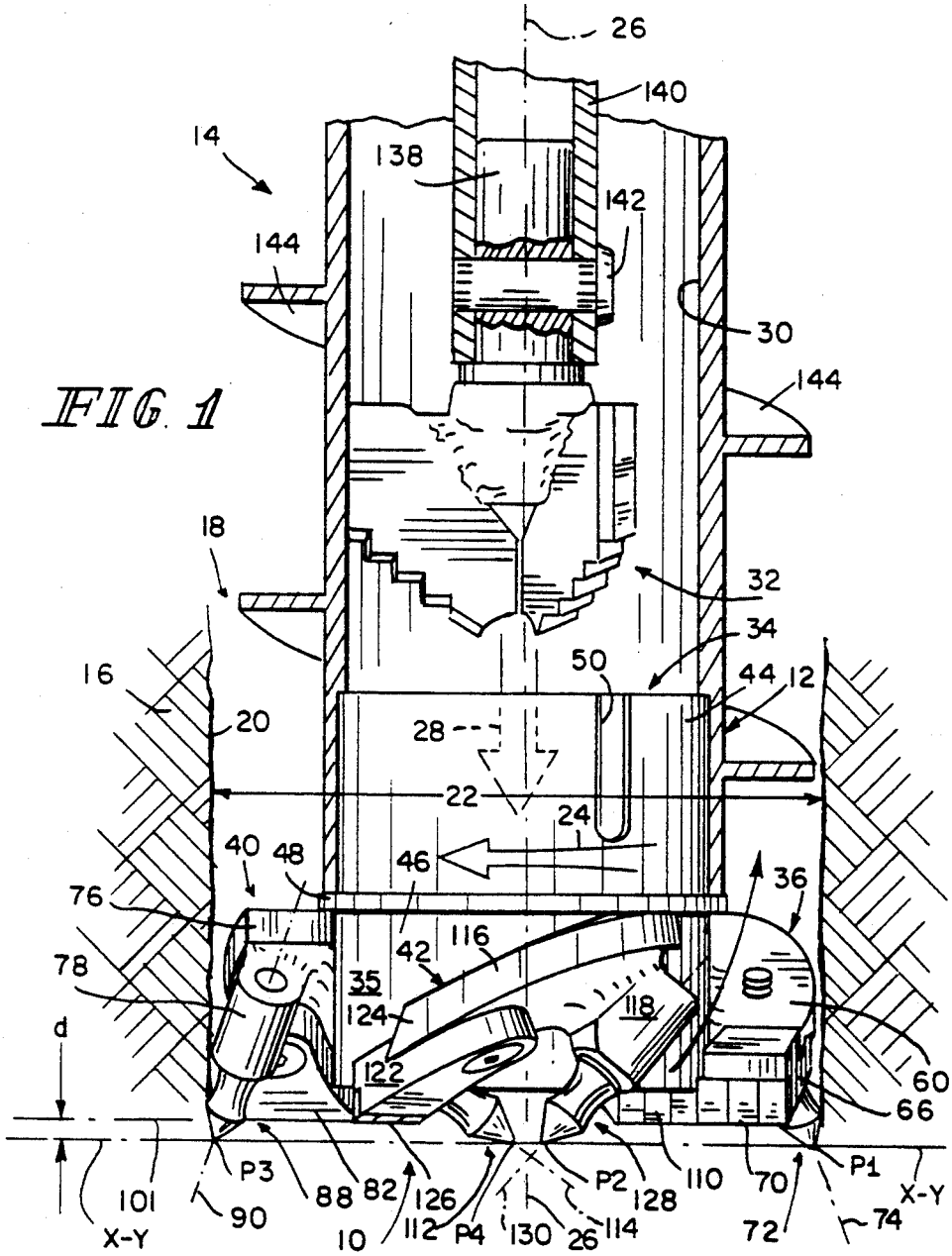
FIG. 1 is a side elevation view of a cutter head deployed in a hole and attached to a hollow-stem auger showing the position of the two spaced-apart outside chisel bits as they rotate to ream or gauge the inner diameter of the hole and of the pilot bit before it is lowered within a central passageway through the auger and the cutter head to drill a lead pilot hole.
Figure 2:
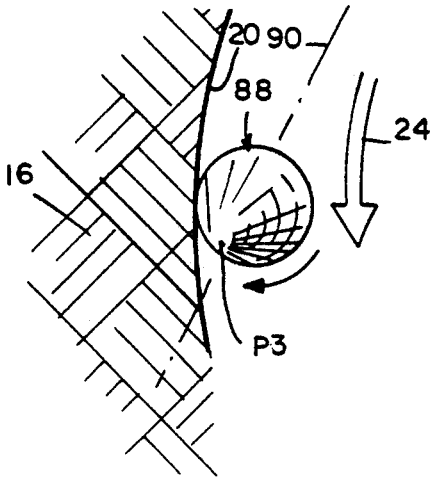
FIG. 2 is an enlarged diagrammatic bottom view of the leftmost outside chisel bit in FIG. 1 showing the direction of rotation of the outside chisel bit about its own axis of rotation in the direction of the small arrow upon engagement of the chisel bit and the ground during rotation of the cutter head in the direction of the large arrow as the hole is being drilled.

A cutter head 10 is mounted on the lowermost end 12 of a hollow-stem auger 14 as shown in FIG. 1. A drill rig (not shown) is coupled to the upper portion (not shown) of the hollow-stem auger 14 and operated to rotate and drive the auger 14 and cutter head 10 into the ground 16 to drill a hole 18 having a cylindrical side wall 20 of a predetermined inner diameter 22. To produce hole 18, the auger 14 simultaneously rotates cutter head 10 in direction 24 about the axis of rotation 26 of the auger 14 and drives cutter head 10 downwardly in direction 28 along the axis of rotation 26 of the auger 14.

Hollow-stem augers such as auger 14 can be driven into the ground to depths of, for example, 300 feet. Essentially, the auger 14 and cutter head 10 are used to advance and case hole 18 simultaneously. Once the auger 14 has reached a desired depth and a pilot bit 32 has been withdrawn from a central passageway 30 formed in the hollow-stem auger 14, various tools (not shown) can be moved downwardly from the surface through the central passageway 30 to reach the ground under the cutter head 10. These tools can be used to provide soil samples, monitor ground water wells, facilitate diamond drilling, place anchor bolts in the ground, load and grout blast holes, conduct environmental testing, determine well location, and/or accomplish many other construction and geotechnical objectives.

Figure 3:
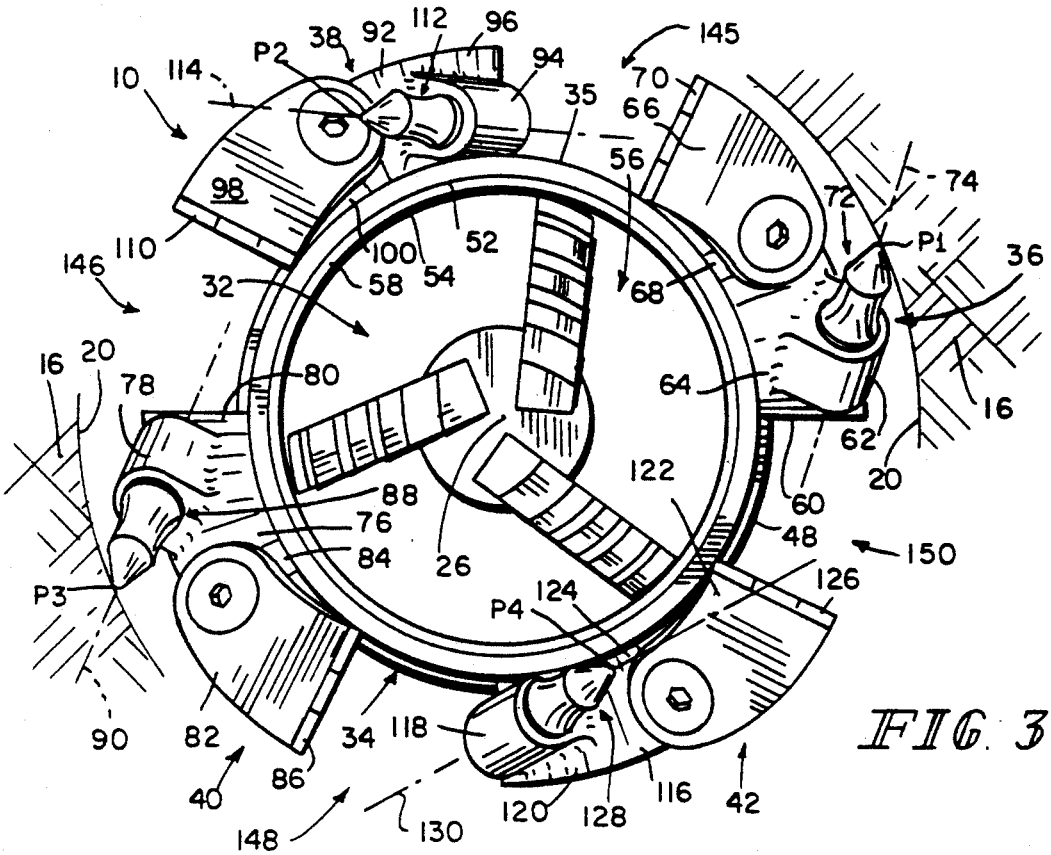
FIG. 3 is an enlarged "pictorial" bottom plan view of the cutter head of FIG. 1 looking up at the cutter head from a vantage point along the axis of rotation of the cutter head and showing the location of the tip and the orientation of the axis of rotation of the two outside chisel bits, the inside chisel bit, and the center chisel bit as well as the flighting sections, bit blocks, and cutter blades on each of the four cutting assemblies mounted on the cutter body.

Referring to FIGS. 1 and 3, cutter head 10 includes a cutter body 34 and four cutting assemblies 36, 38, 40, and 42 mounted on an exterior wall 35 of body 34 and arranged in spaced relation about exterior wall 35 to penetrate and cut the ground 16 and any objects or material (not shown) in the ground !6 during drilling of hole 18. The cutter body 34 is machined from heat treated alloy steel tubing to provide added strength and durability. The cutter body 34 includes a top cylinder member 44, a bottom cylinder member 46, and a radially outwardly extending annular flange 48 around the junction between the members 44 and 46 as shown best in FIG. 1. The lowermost end !2 of auger 14 includes an open mouth that is sized as shown to receive the top cylinder member 44 of the cutter body 34 therein and a bottom rim that is sized to engage and rest on the annular flange 48. Conventional locking means including a keyway 50 formed in the cutter body 34 and a key (not shown) on the auger 14 can be used to lock the cutter body 34 to the hollow stem auger 14 for rotational and axial movement therewith. This and other locking means are well known in the art.

The cutter body 34 is formed to include an upper cylindrical inner side wall 52 and a lower cylindrical inner side wall 54 that cooperate to define a central passageway 56 extending through the top and bottom cylinder members 44 and 45 and communicating with the central passageway 30 formed in the auger 14. A radially inwardly extending, axially upwardly facing annular seat 58 lies at the junction between upper side wall 52 and lower side wall 54 as shown best in FIG. 3.

Referring primarily to FIG. 3, it will be seen that the first cutting assembly 36 includes a flighting section 60 attached to the exterior wall 35 of cutter body 34, a bit block 62 fixed to the tail 64 of the flighting section 60, and a blade holder 66 coupled to the head 68 of the flighting section 60 and carrying a carbide cutter blade 70. A first outside chisel bit 72 is supported in bit block 62 in the usual way for rotation about axis of rotation 74. Likewise, the third cutting assembly 40 includes a flighting section 76 attached to the exterior wall 35 of cutter body 34, a bit block 78 fixed to the tail 80 of the flighting section 76, and a blade holder 82 coupled to the head 84 of the flighting section 76 and carrying a carbide cutter blade 86. A second outside chisel bit 88 is supported in bit block 78 in the usual way for rotation about axis of rotation 90.

Referring to FIG. 1, it will be seen that the first and third cutting assemblies 36, 40 are configured so as to cause the tip $P_1$ of the first outside chisel bit 72 and the tip $P_3$ of the second outside chisel bit 88 to ream or gauge the inner diameter 22 of hole 19 and generate the cylindrical side wall 20 of hole 18 as the auger 14 and cutter body 34 rotate about axis 26 and advance along axis 26 during drilling of hole 18. Advantageously, only the first and second outside chisel bits 72, 88 gauge the hole 18, thereby minimizing abrasive engagement between the ground formation 16 and the flighting sections 60, 76; bit blocks 62, 78; and other portion of the first and third cutting assemblies 36, 40. This reduces wear and tear on the cutting assemblies and extends their useful life.

Referring once again to FIG. 3, it will be seen that the second cutting assembly 38 includes a flighting section 92 attached to the exterior wall 35 of cutter body 34, a bit block 94 fixed to the tail 96 of the flighting section 92, and a blade holder 98 coupled to the head 100 of the flighting section 92 and carrying a carbide cutter blade 110. A center chisel bit 112 is supported in bit block 94 in the usual way for rotation about axis of rotation 114. Likewise, the fourth cutting assembly 42 includes a flighting section 116 attached to the exterior wall 35 of cutter body 34, a bit block 118 fixed to the tail 120 of the flighting section 116, and a blade holder 122 coupled to the head 124 of the flighting section 116 and carrying a carbide cutter blade 126. An inside chisel bit 128 is supported in bit block 118 in the usual way for rotation about axis of rotation 130.

Each of the flighting sections 60, 76, 92, and 116 are fabricated from alloy steel plate and are arc-welded to cutter body 34. The circumferential edges of these flighting sections are treated to provide highly abrasion wear-resistant surfaces. The bit blocks 62, 78, 94, and 118 are arc-welded to the flighting sections 60, 76, 92, and 116 and treated in a similar manner to increase durability.

The bottom plan view in FIG. 3 is pictorial in that it is a view that would be seen by a camera positioned underneath the cutter head 10 and aimed upwardly along axis of rotation 26. The axis of rotation 74, 114, 90, 130 of each chisel bit is thus shown as it would appear from that vantage point along the axis of rotation of cutter head 10.

EXAMPLE

A cutter head !0 as shown in FIGS. 1 and 3 and having the dimensions noted in FIGS. 4–7 was built and operated to produce a hole 18 having an inner diameter of 12.25 inches (31.11 cm). As a result of testing, it was demonstrated that the penetration rate of cutter head 10 in accordance with the present invention was significantly faster than the penetration rate of a conventional cutter head.

Figure 4:
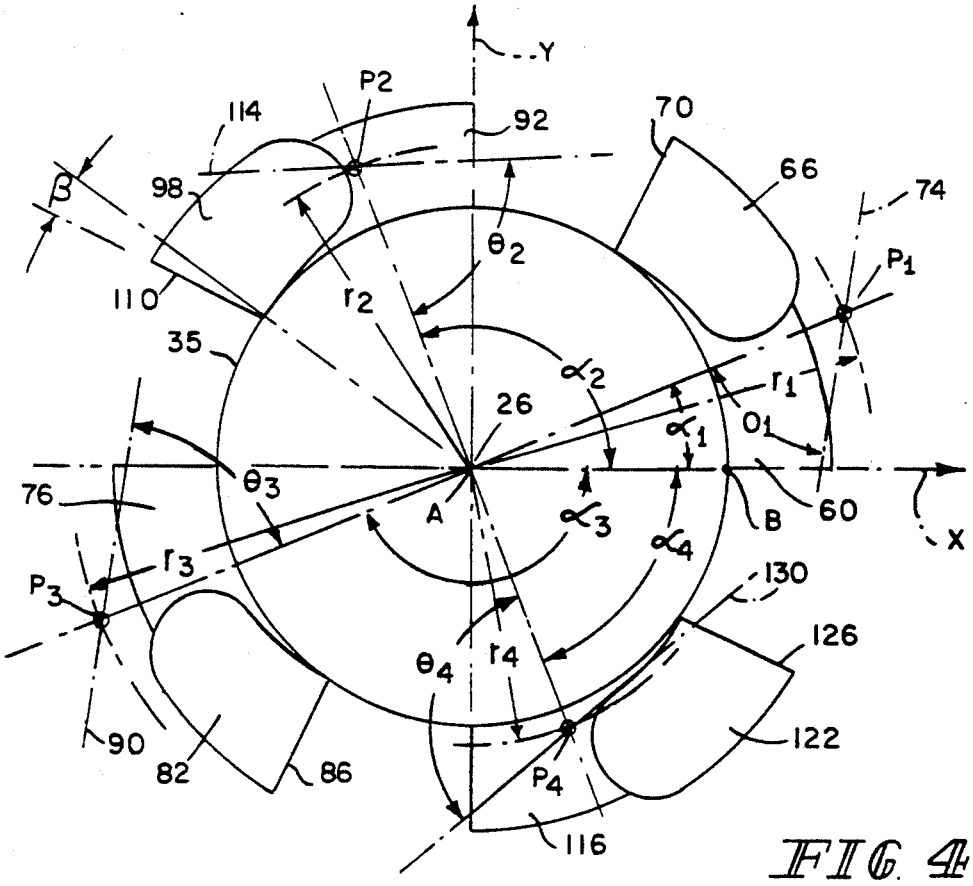
FIG. 4 is a diagrammatic view similar to FIG. 3 showing various dimensions and angles to establish the location and orientation of each of the four chisel bits.

Referring to FIG. 4, it will be seen that an X-Y coordinate axis having an origin A at the axis of rotation 26 of the hollow-stem auger 14 is superimposed onto a diagrammatic view of the cutter head 10 that is similar to the bottom plan view of cutter head 10 provided in FIG. 3. The precise location of each of the chisel bits tips is identified in FIG. 4 using polar coordinates.

An initial line AB is a fixed ray radiating from point A along the X axis. Polar coordinates are used to establish the location in the X-Y plane of each of the following points: $P_1$ which represents the location of the tip of the first outside chisel bit 72, $P_2$ which represents the location of the tip of the center chisel bit 112, $P_3$ which represents the location of the tip of the second outside chisel bit 88, and $P_4$ which represents the location of the tip of the inside chisel bit 128. Each point $P_x$ in plane X-Y is located by an angle $\alpha_x$ (called the vectorial angle) measured from AB to the line determined by A and $P_x$, and the distance $r_x$ (called the radius vector) from A to $P_x$, where $\alpha$ is taken as positive if measured counterclockwise and negative if measured clockwise, and r is taken as positive if measured along the terminal side of angle $\alpha$ and negative if measured along the terminal side of $\alpha$ produced through the pole A. Such an ordered pair of numbers ($r_x$, $\alpha_x$), are called the polar coordinates of the point $P_x$. Using the foregoing convention, the polar coordinates of $P_1$ are (6.00 inches, 22°); of $P_2$ are (4.70 inches, 111° 30'); of $P_3$ are (6.00 inches, −158°); and of $P_4$ are (4.11 inches, −69° 30').

Figure 5:
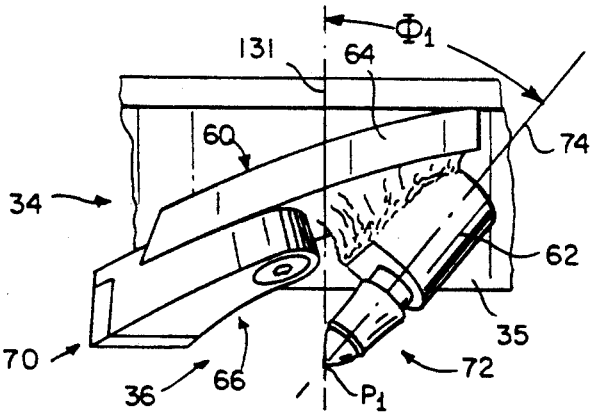
FIG. 5 is a side elevation of the rightmost outside chisel bit of FIG. 1 and its flighting section taken along line $AP_1$ of FIG. 4 and showing the angle at which the axis of, rotation of that rightmost outside chisel bit is canted with respect to the vertical.
Figure 7:
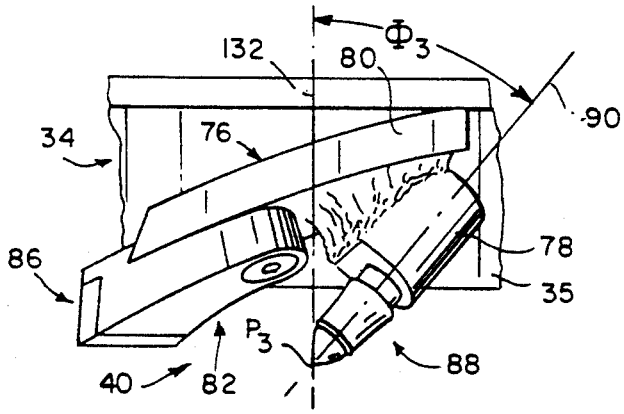
FIG. 7 is a side elevation of the leftmost outside chisel bit of FIG. 1 and its flighting section taken along line $AP_3$ of FIG. 4 and showing the angle at which the axis of rotation of that leftmost outside chisel bit is canted with respect to the vertical.

The axis of rotation 74 of the first outside chisel bit 72 is a compound angle that is a resultant of a first included angle $\Theta_1$ of 59° (as shown in FIG. 4) about point $P_1$ and between the axis of rotation 74 and line $AP_1$ and a second included angle $\Phi_1$ of 40° (as shown in FIG. 5) between the axis of rotation 74 and vertical line 131 through point $P_1$ and parallel to axis of rotation 26. The axis of rotation 90 of the second outside chisel bit 88 is a compound angle that is a resultant of a first included angle $\theta_3$ of 59° (as shown in FIG. 4) about point $P_3$ between the axis of rotation 90 and line $AP_3$ and a second included angle $\Phi_3$ of 40° (as shown in FIG. 7) between the axis of rotation 90 and vertical line 132 through point $P_3$ and parallel to axis of rotation 26.

Figure 6:
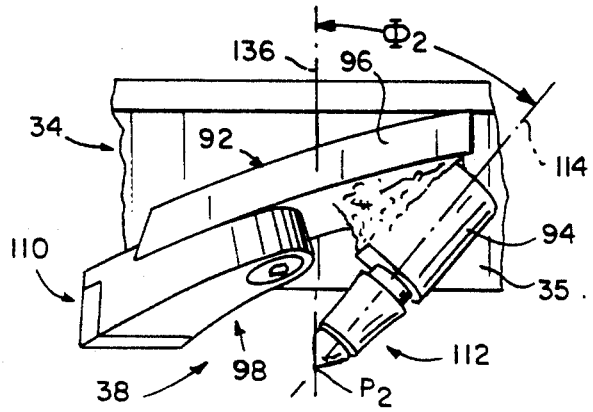
FIG. 6 is a side elevation of the center chisel bit of FIG. 1 and its flighting section taken along line $AP_2$ of FIG. 4 and showing the angle at which the axis of rotation of the inside chisel bit is canted with respect to the vertical.
Figure 8:
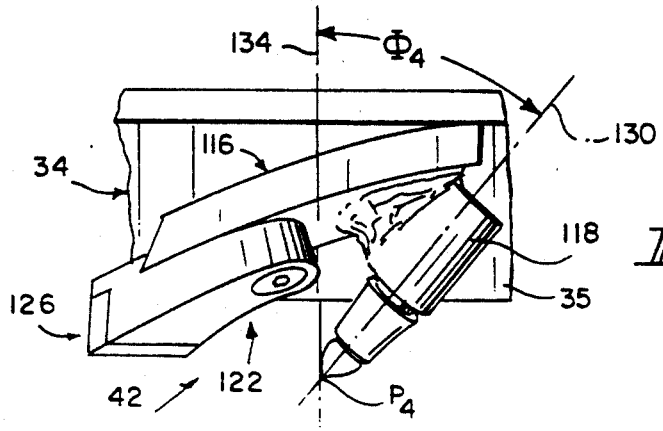
FIG. 8 is a side elevation of the inside chisel bit of FIG. 1 and its flighting section taken along line $AP_4$ of FIG. 4 and showing the angle at which the axis of rotation of the center chisel bit is canted with respect to the vertical.

The axis of rotation 114 of the center chisel bit 112 is a compound angle that is a resultant of a first included angle $\Theta_2$ of 72° (as shown in FIG. 4) about point $P_4$ and between the axis of rotation 114 and line $AP_2$ and a second included angle $\Phi_2$ of 40° (as shown in FIG. 6) between axis of rotation 114 and vertical line 136 through point $P_2$ and parallel to axis of rotation 26. The axis of rotation 130 of the inside chisel bit 128 is a compound angle that is a resultant of a first included angle $\Theta_4$ of 107° (as shown in FIG. 4) about point $P_4$ and between the axis of rotation 130 and line $AF_4$ and a second included angle $\Phi_4$ of 40° (as shown in FIG. 8) between axis of rotation 130 and vertical line 134 through point $P_4$ and parallel to axis of rotation 26.

Further, it will be seen in FIG. 4 that the leading edge of each of cutter blades 70, 110, 86, and 126 is aligned at an angle $\beta$ of 10° relative to a line emanating from point A and intersecting each cutter blade 70, 110, 86, and 126 at the point of contact with exterior wall 35 of cutter body 34. In other embodiments (not shown), this angle $\beta$ varies within a range between 020 and 10°.

Referring to FIG. 1, it will be seen that the chisel bits 72, 88, 112, and 128 are arranged so that each of the chisel bit tips $P_1$, $P_2$, $P_3$, and $P_4$ lie in plane X-Y. Plane X-Y is located a vertical distance "d" of 0.250 inches (0.63 cm) below the plane 101 established by the lowermost edges of each of the cutter blades 70, 110, 86, and 126. This arrangement causes the chisel bits always to lead the cutter blades during drilling of hole 18 to reduce the frequency of engagement between one or more of the cutter blades and unfractured hard ground or hard objects in the ground. Instead, a significant portion of the hard ground and hard objects in the ground is first penetrated and fractured by one or more of the leading chisel bits so that the trailing cutter blades are exposed primarily to the rubble produced by the leading chisel bits.

The pilot bit 32 is shown in FIGS. 1 and 3. Pilot bit 32 includes a shank 138 that fits into center rod 140 and is held in place by retaining bolt 142. Pilot bit 32 rotates about and advances along axis of rotation 26 to generate a leading pilot hole having an internal diameter that is slightly less than the inner diameter of the lower cylindrical side wall 54 in cutter body 34. The inside chisel bit 128 is oriented as shown in FIG. 3 to position its tip $P_4$ in a radially inwardly offset direction relative to the location of the other tips $P_1$, $P_2$, and $P_3$ so that it operates to enlarge the diameter of the pilot hole during rotation of cutter body 34 about axis of rotation 26. Such enlargement produces a larger diameter hole than could otherwise be produced by pilot bit 32, thus providing sufficient clearance to receive the annular side wall of auger 12 therethrough during downward movement of auger 12 into the ground.

Each chisel bit 72, 112, 88, and 128 is positioned so that only its carbide tip ($P_1$, $P_2$, $P_3$, or $P_4$) penetrates the ground and the material in the ground to be cut. Each chisel bit fractures and cuts separate portions of the total volume that the cutter head flighting advances through. As the ground and any material in the ground is cut, the cutter blades 70, 110, 86, and 126 collect and convey the cuttings up and away from the bottom of hole 18, keeping the lower portion of the hole 18 free of cuttings or spoils. The flighting 144 on the auger 114 itself assists in discharging cuttings out of hole 18 in the usual way. Advantageously, the radially outermost edges of the flighting sections, bit blocks, cutter blades, and blade holders are offset radially inwardly toward axis of rotation 26 relative to the location of the tips $P_1$, $P_3$ of the first and second outside chisel bits 72, 88. This results in protection of these components from premature wear because the hole gauge is maintained exclusively by the first and second outside chisel bits 72, 88.

In addition, the cutter blades 70, 110, 86, and 126 are positioned to rest against the exterior surface 35 of cutter body 34 so that they cannot turn or pivot into the pilot hole during drilling of hole 18. This feature ensures an open center when the center rod 140 and pilot bit 32 are removed from hollow-stem auger 14 for sampling, coring, or other operations. Moreover, the cutter blades and chisel bits are located as close as possible to each other on each flight section. This creates areas 145, 146, 148, and 150 as large as possible between each pair of adjacent cutting assemblies for spoils or cuttings to be conveyed unrestricted out of the bottom of hole 18 up the helical flight 144 on auger 14.

Although the invention has been described in detail with reference to certain preferred embodiments and specific examples, variations and modifications exist within the scope and spirit of the invention as described and defined in the following claims.

What is claimed is:

1. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, and a plurality of spaced-apart cutting assemblies mounted on the cutter body, a first of the cutting assemblies including a first outside chisel bit having a base and a tip and first mounting means for mounting the base on the cutter body to position the tip at a first predetermined distance from the axis of rotation to gauge the predetermined inner diameter of the hole to be drilled so that the first outside chisel bit penetrates material in the ground to be cut and the tip generates the cylindrical side wall of the hole to be drilled in response to motion of the cutter body around and along the axis of rotation of the hollow-stem auger during drilling of the hole, the first mounting means including a flighting section, the flighting section including an outermost edge portion offset from the tip of the first outside chisel bit in a radially inward direction toward the axis of rotation of the hollow-stem auger to lie in spaced relation to the cylindrical side wall of the hole during rotation to the cylindrical side wall of the hole during rotation of the cutter body about the axis of rotation of the hollow-stem auger so that only the tip of the first outside chisel bit gauges the predetermined inner diameter of the hole as the tip orbits about the axis of rotation of the hollow-stem auger during drilling of the hole.

2. The cutter head of claim 1, wherein the flighting section is attached to the cutter body, the first mounting means includes a bit block attached to the flighting section, and the bit block is formed to include means for supporting the first outside chisel bit for rotation about its axis of rotation so that the first outside chisel bit rotates about its first axis of rotation upon frictional engagement with the ground during rotation of the cutter body about the axis of rotation of the hollow-stem auger.

3. The cutter head of claim 1, wherein a second of the cutting assemblies includes a second outside chisel bit having a second outside chisel bit base and a second outside chisel bit tip and second mounting means for mounting the second outside chisel bit base on the cutter to position the second outside chisel bit tip at the first predetermined distance from the axis of rotation to assist the first outside chisel bit tip in gauging the predetermined diameter of the hole to be drilled so that the first and second outer chisel tip tips cooperate to generate the cylindrical side wall of the hole to be drilled in response to motion of the cutter body around and along the axis of rotation of the hollow-stem auger during drilling of the hole.

4. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, and a plurality of spaced-apart cutting assemblies mounted on the cutter body, a first of the cutting assemblies including a first outside chisel bit having a base and a tip and first mounting means for mounting the base on the cutter body to position the tip at a first predetermined distance from the axis of rotation to gauge the predetermined inner diameter of the hole to be drilled so that the first outside chisel bit penetrates material in the ground to be cut and the tip generates the cylindrical side wall of the hole to be drilled in response to motion of the cutter body around and along the axis of rotation of the hollow-stem auger during drilling of the hole, the first mounting means includes a flighting section attached to the cutter body and a bit block attached to the flighting section, the bit block being formed to include means for supporting the first outside chisel bit for rotation about its axis of rotation so that the first outside chisel bit rotates about its first axis of rotation upon frictional engagement with the ground during rotation of the cutter body about the axis of rotation of the hollow-stem auger, wherein the axis of rotation of the first outside chisel bit is aligned at a predetermined compound angle relative to the axis of rotation of the hollow-stem auger and the predetermined compound angle is a resultant of a first included angle of 59° between the axis of rotation of the first outside chisel bit and a line intersecting both of the tip of the first outside chisel bit and the axis of rotation of the hollow-stem auger and a second included angle of 40° between the axis of rotation of the first outside chisel bit and a line parallel to the axis of rotation of the hollow-stem auger and intersecting the tip of the first outside chisel bit.

5. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, and a plurality of spaced-apart cutting assemblies mounted on the cutter body, a first on the cutting assemblies including a first outside chisel bit having a base and a tip and first mounting means for mounting the base on the cutter body to position the tip at a first predetermined distance from the axis of rotation to gauge the predetermined inner diameter of the hole to be drilled so that the first outside chisel bit penetrates material in the ground to be cut and the tip generates the cylindrical side wall of the hole to be drilled in response to motion of the cutter body around and along the axis of rotation of the hollow-stem auger during drilling of the hole, the first mounting means including a flighting section attached to the cutter body and a bit block attached to the flighting section, the bit block being formed to include means for supporting the first outside chisel bit for rotation about its axis of rotation so that the first outside chisel bit rotates about its first axis of rotation upon frictional engagement with the ground during rotation of the cutter body about the axis of rotation of the hollow-stem auger, each of the flighting section and the bit block including an outermost edge portion offset from the tip of the first outside chisel bit in a radially inward direction toward the axis of rotation of the hollow-stem auger to lie in spaced relation to the cylindrical side wall of the hole during rotation of the cuter body about the axis of rotation of the hollow-stem auger so that only the tip of the first outside chisel bit gauges the predetermined inner diameter of the hole as the tip orbits about the axis of rotation of the hollow-stem auger during drilling of the hole.

6. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, and a plurality of spaced-apart cutting assemblies mounted on the cutter body, a first of the cutting assemblies including a first outside chisel bit having a base and a tip and first mounting means for mounting the base on the cutter body to position the tip of at a first predetermined distance from the axis of rotation to gauge the predetermined inner diameter of the hole to be drilled so that the first outside chisel bit penetrates material in the ground to be cut and the tip generates the cylindrical side wall of the hole to be drilled in response to motion of the cutter body around and along the axis of rotation of the hollow-stem auger during drilling of the hole, a second of the cutting assemblies including a second outside chisel bit having a second outside chisel bit base and a second outside chisel bit tip and second mounting means for mounting the second outside chisel bit base on the cutter to position the second outside chisel bit tip at the first predetermined distance from the axis of rotation to assist the first outside chisel bit tip in gauging the predetermined diameter of the hole to be drilled so that the first and second outer chisel bit tips cooperate to generate the cylindrical side wall of the hole to be drilled in response to motion of the cutter body around and along the axis of rotation of the hollow-stem auger during drilling of the hole, each of the first and second mounting means including a flighting section and each flighting section including an outermost edge portion offset from the tips of the first and second outside chisel bits in a radially inward direction toward the axis of rotation of the hollow-stem auger to lie in spaced relation to the cylindrical side wall of the hole during rotation of the cutter body about the axis of the hollow-stem auger so that only the tips of the first and second outside chisel bits gauge the predetermined inner diameter of the hole as the tips orbit about the axis of rotation of the hollow-stem auger during drilling of the hole.

7. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, and a plurality of spaced-apart cutting assemblies mounted on the cutter body, a first of the cutting assemblies including a first outside chisel bit having a base and a tip and first mounting means for mounting the base on the cutter body to position the tip at a first predetermined distance from the axis of rotation to gauge the predetermined inner diameter of the hole to be drilled so that the first outside chisel bit penetrates material in the ground to be cut and the tip generates the cylindrical side wall of the hole to be drilled in response to motion of the cutter body around and along the axis of rotation of the hollow-stem auger during drilling of the hole, a second of the cutting assemblies including a second outside chisel bit having a second outside chisel bit base and a second outside chisel bit tip and second mounting means for mounting the second outside chisel bit base on the cutter to position the second outside chisel bit tip at the first predetermined distance from the axis of rotation to assist the first outside chisel bit tip in gauging the predetermined diameter of the hole to be drilled so that the first and second outer chisel bit tips cooperate to generate the cylindrical side wall of the hole to be drilled in response to motion of the cutter body around and along the axis of rotation of the hollow-stem auger during drilling of the hole, the second mounting means including a flighting section attached to the cutter body and a bit block attached to the flighting section, the bit block being formed to include means for supporting the second outside chisel bit for rotation about its axis of rotation so that the second outside chisel bit rotates about its axis of rotation upon frictional engagement with the ground during rotation of the cutter body about the axis of rotation of the hollow-stem auger, wherein the axis of rotation of the second outside chisel bit is aligned at a predetermined compound angle relative to the axis of rotation of the hollow-stem auger and the predetermined compound angle is a resultant of a first included angle of 59° between the axis of rotation of the second outside chisel bit and a line intersecting both of the tip of the second outside chisel bit and the axis of rotation of the hollow-stem auger and a second included angle of 40° between the axis of rotation of the second outside chisel bit and a line parallel to the axis of rotation of the hollow-stem auger and intersecting the tip of the second outside chisel bit.

8. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, and a plurality of spaced-apart cutting assemblies mounted on the cutter body, a first of the cutting assemblies including a first outside chisel bit having a base and a tip and first mounting means for mounting the base on the cutter body to position the tip at a first predetermined distance from the axis of rotation to gauge the predetermined inner diameter of the hole to be drilled so that the first outside chisel bit penetrates material in the ground to be cut and the tip generates the cylindrical side wall of the hole to be drilled in response to motion of the cutter body around and along the axis of rotation of the hollow-stem auger during drilling of the hole, a second of the cutting assemblies including a second outside chisel bit having a second outside chisel bit base and a second outside chisel bit tip and second mounting means for mounting the second outside chisel bit base on the cutter to position the second outside chisel bit tip at the first predetermined distance from the axis of rotation to assist the first outside chisel bit tip in gauging the predetermined diameter of the hole to be drilled so that the first and second outer chisel bit tips cooperate to generate the cylindrical side wall of the hole to be drilled in response to motion of the cutter body around and along the axis of rotation of the hollow-stem auger during drilling of the hole, the second mounting means including a flighting section attached to the cutter body and a bit block attached to the flighting section, the bit block being formed to include means for supporting the second outside chisel bit for rotation about its axis of rotation so that the second outside chisel bit rotates about its axis of rotation upon frictional engagement with the ground during rotation of the cutter body about the axis of rotation of the hollow-stem auger, each of the flighting section and the bit block including an outermost edge portion offset from the tip of the second bit outside chisel in a radially inward direction toward the axis of rotation of the hollow-stem auger to lie in spaced relation to the cylindrical side wall of the hole during rotation of the cutter body about the axis of rotation of the hollow-stem auger so that only the tip of the second outside chisel bit gauges the predetermined diameter of the hole as the tip orbits about the axis of rotation of the hollow-stem auger during drilling of the hole.

9. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therein, a plurality of spaced-apart cutting assemblies mounted on the cutter body, a first of the cutting assemblies including a first outside chisel bit having a base and a tip and first mounting means for mounting the base on the cutter body to position the tip at a first predetermined distance from the axis of rotation to gauge the predetermined inner diameter of the hole to be drilled so that the first outside chisel bit penetrates material in the ground to be cut and the tip generates the cylindrical side wall of the hole to be drilled in response to motion of the cutter body around and along the axis of rotation of the hollow-stem auger during drilling of the hole, a second of the cutting assemblies including a second outside chisel bit having a second outside chisel bit base and a second outside chisel bit tip and second mounting means for mounting the second outside chisel bit base on the cutter to position the second outside chisel bit tip at the first predetermined distance from the axis of rotation to assist the first outside chisel bit tip in gauging the predetermined diameter of the hole to be drilled so that the first and second outer chisel bit tips cooperate to generate the cylindrical side wall of the hole to be drilled in response to motion of the cutter body around and along the axis of rotation of the hollow-stem auger during drilling of the hole, and pilot bit means for drilling a pilot hole having an internal diameter that is less than the predetermined inner diameter of the hole to be drilled by the cutting assemblies, the cutter body being formed to include a central passageway having an axis coextensive with the axis of rotation of the hollow-stem auger, the pilot bit means being arranged to extend downwardly through the central passageway of the cutter body to lead the cutting assemblies during drilling of the hole for receiving the hollow-stem auger, and wherein a third of the cutting assemblies includes an inside chisel bit having an inside chisel bit base and an inside chisel bit tip and third mounting means for mounting the inside chisel bit base to the cutter body to position the inside chisel bit tip at a second predetermined distance from the axis of rotation to enlarge the pilot hole to produce a coring hole so that the inside chisel bit penetrates material in the ground to be cut and the inside chisel bit tip generates a cylindrical side wall of a coring hole that has an inner diameter that is larger than the internal diameter of the pilot hole and smaller than the predetermined inner diameter of the auger-receiving hole and thereby gauges the inner diameter of the coring hole to permit coring tools, soil sampling equipment, in-hole hammers, environment monitoring equipment, or other apparatus to be inserted through the hollow-stem auger and central passageway of the cutter body into the coring hole.

10. The cutter head of claim 9, wherein a fourth of the cutting assemblies includes a central chisel bit having a center chisel bit base and a center chisel bit tip and fourth mounting means for mounting the center chisel bit base to the cuter body to position the center chisel bit tip at a third predetermined distance from the axis of rotation of the hollow-stem auger so that the center chisel bit is offset radially inwardly of the first and second outside chisel bits and radially outwardly of the inside chisel bit to penetrate and fracture material in the ground between the inner and outer chisel bits.

11. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, the cutter body being formed to include a central passageway having an axis coextensive with the axis of rotation of the hollow-stem auger, a plurality of spaced-apart cutting assemblies mounted on the cutter body, a first of the cutting assemblies including an outside chisel bit having a base and a tip and first mounting means for mounting the base on the cutter body to position the tip at a first predetermined distance from the axis of rotation to gauge the predetermined inner diameter of the hole to be drilled so that the outside chisel bit penetrates material in the ground to be cut and the tip generates the cylindrical side wall of the hole to be drilled in response to motion of the cutter body around and along the axis of rotation of the hollow-stem auger during drilling of the hole, and pilot bit means for drilling a pilot hole having an internal diameter that is less than the predetermined inner diameter of the hole to be drilled by the cutting assemblies, the pilot bit means being arranged to extend downwardly through the central passageway of the cutter body to lead the cutting assemblies during drilling of the hole for receiving the hollow-stem auger, a second of the cutting assemblies including an inside chisel bit having an inside chisel bit base and an inside chisel bit tip and second mounting means for mounting the inside chisel bit base to the cutter body to position the inside chisel bit tip at a second predetermined distance from the axis of rotation to enlarge the pilot hole to produce a coring hole so that the inside chisel bit penetrates material in the ground to be cut and the inside chisel bit tip generates a cylindrical side wall of a coring hole that has an inner diameter that is larger than the internal diameter of the pilot hole and smaller than the predetermined inner diameter of the auger-receiving hole and thereby gauges the inner diameter of the coring hole to permit coring tools, soil sampling equipment, in-hole hammers, environmental monitoring equipment, or other apparatus to be inserted through the hollow-stem auger and central passageway of the cutter body into the coring hole.

12. The cutter head of claim 11, wherein a third of the cutting assemblies includes a center chisel bit having a center chisel bit base and a center chisel bit tip and third mounting means for mounting the center chisel bit base to the cutter body to position the center chisel bit tip at a third predetermined distance from the axis of rotation of the hollow-stem auger so that the center chisel bit is offset radially inwardly of the outside chisel bit and radially outwardly of the inside chisel bit to penetrate and fracture material in the ground between the inside and outside chisel bits.

13. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, a plurality of spaced-apart cutting assemblies mounted on the cutter body, each cutting assembly including a flighting section mounted on the cutter body and a chisel bit having a base and a tip, each flighting section including a radially outermost edge portion, at least one of the cutting assemblies including means for mounting the base of the chisel bit on the flighting section to position the tip of the chisel bit at a predetermined distance from the axis of rotation that is radially outwardly offset relative to the radially outermost edge portion of each flighting section so that only the chisel bit tip of said at least one of the cutting assemblies gauges the predetermined inner diameter of the hole as said chisel bit tip orbits the axis of rotation of the hollow-stem auger during drilling of the hole.

14. The cutter head of claim 13, wherein each cutting assembly further includes a cutter blade and blade holder means for mounting the cutter blade on the flighting section, each of the cutter blades and the blade holder means includes a radially outermost edge portion, and the radially outermost edge portion of each of the cutter blades and the blade holder means is offset from the tip of the chisel bit of said at least one of the cutting assemblies in a radially inward direction toward the axis of rotation of the hollow-stem auger to lie in spaced relation to the cylindrical side wall of the hole during rotation of the hollow-stem auger so that only the chisel bit tip of said at least one of the cutting assemblies gauges the predetermined inner diameter of the hole as said chisel bit tip orbits the axis of rotation of the hollow-stem auger during drilling of the hole.

15. The cutter head of claim 13, wherein two of the cutting assemblies include said mounting means so that two chisel bit tips are positioned in spaced-apart relation about the circumference of the cutter body to gauge the predetermined inner diameter of the hole as the two chisel bit tips orbit the axis of rotation of the hollow stem auger to balance the cutter head and center the cutter body as it moves downwardly along the axis of rotation of the hollow-stem auger during drilling of the hole.

16. The cutter head of claim 15, wherein four cutting assemblies are mounted on the cutter body, a third of the cutting assemblies is mounted in one of the spaces around the cutter body and between said two spaced-apart chisel bit tips, and a fourth of the cutting assemblies is mounted in the other of the spaces around the cutter body and between said two spaced-apart chisel bit tips.

17. The cutter head of claim 13, wherein each cutting assembly further includes a cutter blade and blade holder means for mounting the cutter blade on the flighting section so that the cutter blade cuts and fractures fragments of material generated by engagement of the chisel bits and material to be cut in the ground during drilling of the hole and the cutter body includes means for blocking radially inward movement of the cutter blades and blade holder means toward the axis of rotation and relative to the flighting sections in response to motion of the cutter body around and along the axis of rotation of the hollow-stem auger during drilling of the hole.

18. The cutter head of claim 17, wherein the blocking means includes an axially extending wall appended to the connecting means.

19. The cutter head of claim 17, wherein the connecting means includes a first cylindrical wall and means on the first cylindrical wall for mating with the hollow-stem auger and the blocking means includes a second cylindrical wall appended to the first cylindrical wall and positioned to abut at least the blade holder means of each cutting assembly.

20. A cutter head for a hollow-stem auger, the cutter head rotating with the hollow-stem auger about its axis of rotation to drill into the ground to produce a hole having a cylindrical side wall of a predetermined inner diameter, the cutter head comprising a cutter body including means for connecting to the hollow-stem auger to rotate and move therewith, and a plurality of spaced-apart cutting assemblies on the cutter body, each cutting assembly including a chisel bit having an axis of rotation and journal means appended to the cutter body for supporting the chisel bit for rotation at about its axis of rotation and aligning the axis of rotation of the chisel bit at a predetermined compound angle relative to the axis of rotation of the hollow-stem auger, a first of the cutting assemblies including a first chisel bit and a first of the journal means, the first of the journal means being configured to align the first chisel bit supported thereon at a predetermined compound angle that is the resultant of a first included angle of 59° between the axis of rotation of the first chisel bit and a line intersecting both of a distal tip of the first chisel bit and the axis of rotation of the hollow-stem auger and a second included angle of 40° between the axis of rotation of the first chisel bit and a line parallel to the axis of rotation of the hollow-stem auger and intersecting the tip of the first chisel bit.

21. The cutter head of claim 20, wherein a second of the cutting assemblies includes a second chisel bit and a second of the journal means, the second of the journal means is configured to align the second chisel bit supported thereon at a predetermined compound angle that is the resultant of a first included angle of 59° between the axis of rotation of the second chisel bit and a line intersecting both of a distal tip of the second chisel bit and the axis of rotation of the hollow-stem auger and a second included angle of 40° between the axis of rotation of the second chisel bit and a line parallel to the axis of rotation of the hollow-stem auger and intersecting the tip of the second chise bit.

22. The cutter head of claim 20, wherein a second of the cutting assemblies includes a second chisel bit and a second of the journal means, the second of the journal means is configured to align the second chisel bit supported thereon at a predetermined compound angle that is the resultant of a first included angle of 72° between the axis of rotation of the second chisel bit and a line intersecting both of a distal tip of the second chisel bit and the axis of rotation of the hollow-stem auger and a second included angle of 40° between the axis of rotation of the second chisel bit and a line parallel to the axis of rotation of the hollow-stem auger and intersecting the tip of the second chisel bit, and a third of the cutting assemblies includes a third chisel bit and a third of the journal means, the third of the journal means configured to align the third chisel bit supported thereon at a predetermined compound angle that is the resultant of a first included angle of 107° between the axis of rotation of the third chisel bit and a line intersecting both of a distal tip of the third chisel bit and the axis of rotation of the hollow-stem auger and a second included angle of 40° between the axis of rotation of the third chisel bit and a line parallel to the axis of rotation of the hollow-stem auger and intersecting the tip of the third chisel bit.

23. The cutter head of claim 22, wherein a fourth of the cutting assemblies includes a fourth chisel bit and a fourth of the journal means, the fourth of the journal means is configured to align the fourth chisel bit supported thereon at a predetermined compound angle that is the resultant of a first included angle of 59° between the axis of rotation of the fourth chisel bit and a line intersecting both of a distal tip of the fourth chisel bit and the axis of rotation of the hollow-stem auger and a fourth included angle of 40° between the axis of rotation of the fourth chisel bit and a line parallel to the axis of rotation of the hollow-stem auger and intersecting the tip of the fourth chisel bit.

* * * * *